US005320220A

United States Patent [19]

Purkiss

[11] Patent Number: 5,320,220

[45] Date of Patent: Jun. 14, 1994

[54] GARMENT CARRIER

[75] Inventor: Dennis Purkiss, Chicago, Ill.

[73] Assignee: American Guard-It Manufacturing, Inc., Chicago, Ill.

[21] Appl. No.: 856,255

[22] Filed: Mar. 25, 1992

[51] Int. Cl.[5] ..... B65D 85/18

[52] U.S. Cl. ..... 206/287.1; 206/285; 206/286; 223/85

[58] Field of Search ..... 223/85, 88, 98; 206/284, 285, 286, 287, 287.1, 289, 290, 291

[56] References Cited

U.S. PATENT DOCUMENTS

| | | | |
|---|---|---|---|
| 1,651,706 | 12/1927 | Holbrook | 206/287 |
| 2,086,895 | 7/1937 | Cart . | |
| 2,261,291 | 11/1941 | Salavsky . | |
| 2,378,665 | 6/1945 | Threeton | 206/286 |
| 2,596,412 | 5/1952 | Kish, Jr. et al. . | |
| 2,877,941 | 3/1959 | Melone | 223/88 |
| 3,115,959 | 12/1963 | Jaffe . | |
| 3,244,261 | 4/1966 | Herz . | |
| 3,291,266 | 12/1966 | Komroff . | |
| 4,007,861 | 2/1977 | Duester et al. | 223/85 |
| 4,655,343 | 4/1987 | Lane et al. | 206/287.1 |
| 4,753,329 | 6/1988 | Choy . | |
| 4,801,010 | 1/1989 | Levitas | 206/279 |
| 4,817,791 | 4/1989 | Adams | 206/287.1 |
| 4,927,014 | 5/1990 | Pulichino, Jr. | 206/287.1 |

FOREIGN PATENT DOCUMENTS

| | | | |
|---|---|---|---|
| 2559662 | 8/1985 | France | 223/85 |
| 81653 | 4/1953 | Norway | 206/286 |
| 0002836 | 8/1984 | World Int. Prop. O. | 223/85 |

*Primary Examiner*—Allan N. Shoap
*Assistant Examiner*—Jes F. Pascua
*Attorney, Agent, or Firm*—Fitch, Even, Tabin & Flannery

[57] ABSTRACT

Disclosed is a garment carrier comprising a base frame in the general shape of a hanger, with a triangular-shaped lower portion integral with an arcuate shaped hand gripping hook-like portion. The base hanger is insertable into the interior of a cover, with the lower triangular-shaped portion of the base hanger residing within the interior of the cover, and the upper arcuate hand gripping portion extending through an opening in the upper end of the cover, residing external of the cover. A support strap, having an upper aperture and a lower aperture, is slidably received onto the base frame by receipt of the arcuate hand gripping portion of the base frame into the upper aperture of the strap. The hooks of the plurality of clothes hangers with their respective garments are slidably received into the lower aperture of the support strap. The garment carrier, with hanger supported garments, may then be transported by gripping the hand gripping portion of the base frame which extends outward of the cover. The upper aperture of the support strap resides at the junction of the upper and lower base frame portions, with the lower aperture of the support strap depending downwardly into the cover interior, and the clothes hangers with their respective garments also residing within the cover.

2 Claims, 2 Drawing Sheets

Fig. 4
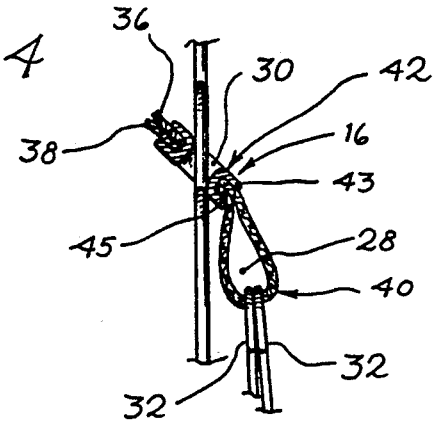
Fig. 5
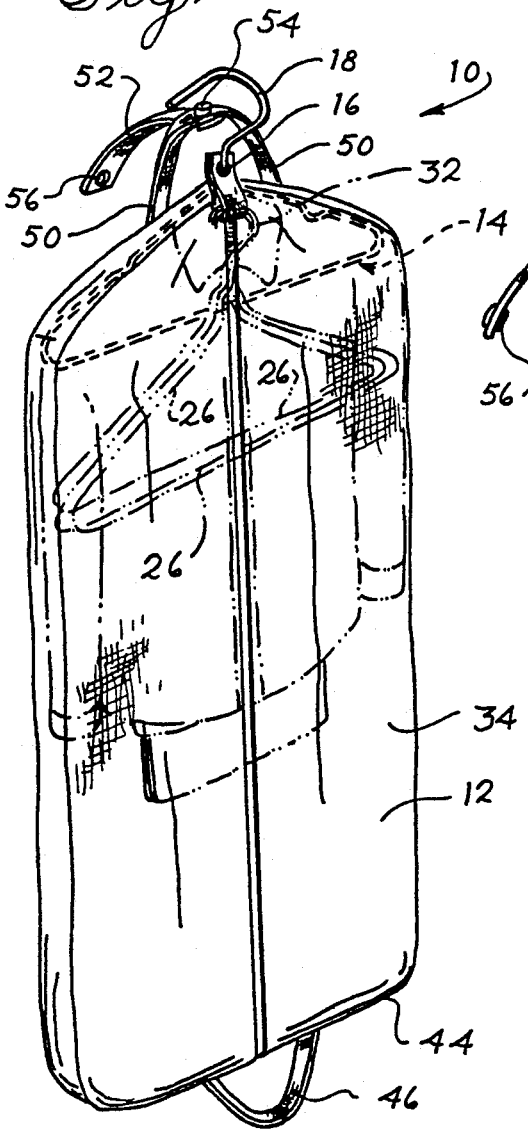
Fig. 7
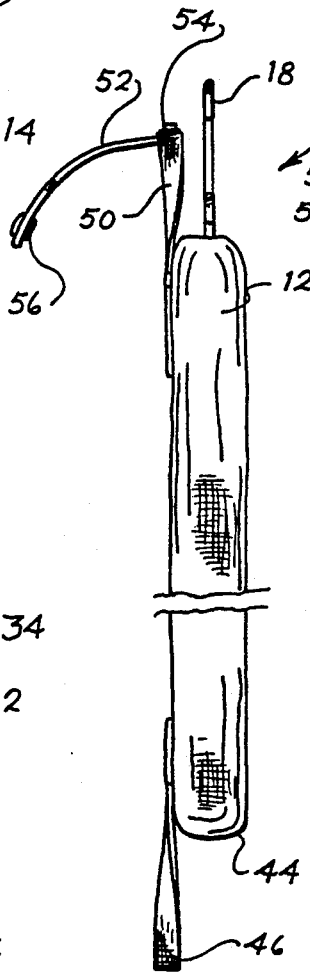
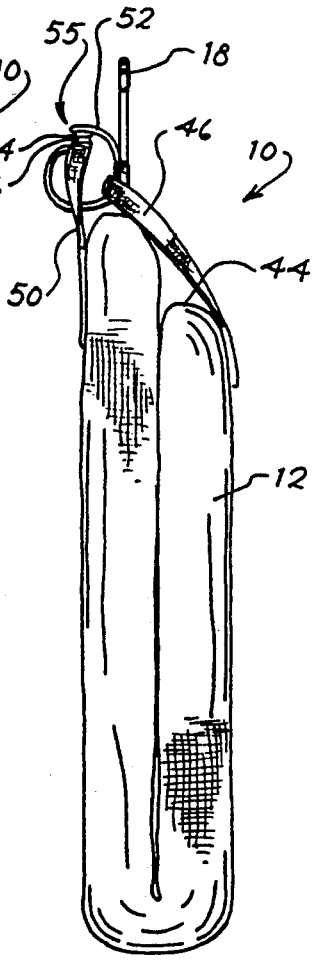
Fig. 6

GARMENT CARRIER

FIELD OF THE INVENTION

The present invention relates to garment carriers and, more particularly relates to a garment carrier for supporting a plurality of garments mounted on respective hangers to facilitate transport thereof.

BACKGROUND OF THE INVENTION

Garment carriers are well known as an efficient means for transporting garments which are mounted on hangers, and have found widespread use amongst both corporate and personal travelers. Garment carriers are preferable to garment bags in that with garment carriers each of the garments is supported on a respective hanger which keeps the garment relatively wrinkle-free, as compared to garment carriers in which a number of garments are folded and placed in a common bag.

With one type of prior art garment carrier, each of the garments, while supported on their respective hangers, is placed inside a garment cover with the hook portion of each of the individual hangers extending through an opening in the upper end of the cover, and the lower portion of the hangers with garments thereon residing within the cover. The garments are transported by manually grasping the plurality of hangers by their hooks which extend through the upper end of the cover. This design suffers numerous shortcomings, the most particular of which is that the hooks of the hangers dig into the hand, making transport of the garments for any significant time very uncomfortable. The discomfort may become intolerable if the garments have substantial weight.

To alleviate the discomfort associated with gripping and supporting the garments by their hanger hooks, other designs have provided a support hoop permanently affixed to the interior of the cover near its upper end. Each of the hooks of the hangers on which a garment is supported is received in the support hoop with the garments hanging within the cover. A strap is affixed to the upper end of the cover, by which the garment carrier can be lifted to allow the garments to be transported comfortably. This design requires that the upper portion of the cover, at the location of the support hoop and carrying strap, be reinforced to withstand tearing of the cover during transport. The requirement of the reinforcement to the cover adds considerably to the cost of manufacturing garment carriers of this design, as compared with the aforementioned design having simply a cover with an opening in its upper end for passage of the hanger hooks therethrough. The reinforcement also adds undesirable weight to the garment carrier. While the cover may, alternatively, be made heavier to withstand the load of the garments, this also would add considerably to the expense of producing the garment carrier, as well as adding further undesirable weight to the garment carrier. Furthermore, there are additional manufacturing expenses associated with this design attributable to the requirements of affixing the support hoop within the cover, and affixing a support hook to the cover by which the garments can hang from a coat rack or the like in a conventional manner.

It is desirable to provide a garment carrier which combines the beneficial attributes of being simple and inexpensive to manufacture, with allowing for comfortable gripping and transport of the garment carrier.

SUMMARY OF THE INVENTION

In accordance with the present invention, a garment carrier is provided which allows for the covered transport of a plurality of hanger-mounted garments for extended periods without discomfort to the hand gripping the garment carrier. The garment carrier of the present invention is lightweight, and lends itself to simple and economical manufacture.

In the preferred embodiment of the present invention, the garment carrier comprises a rigid frame having a configuration of a conventional hanger. The frame is formed of rod stock which is bent generally into the shape of a conventional hanger, having an upper, arcuate hook-like portion and lower, triangular-shaped garment supporting portion. A lightweight cover is provided having an opening at its upper end through which the hook-like portion of the frame extends outward of the cover, with the lower triangular-shaped portion of the frame residing within the cover and supporting the cover thereupon.

A hoop or strap having an upper aperture and a lower aperture is slidably received onto the frame, with the upper hook-like portion of the frame being received within the upper aperture of the hoop or strap, and the lower aperture of the hoop or strap hanging downward into the cover. The lower aperture of the hoop or strap is sufficiently large to receive the hooks of each of the plurality of clothes hangers on which garments are hung. Hence, the plurality of hangers, with their respective garments, hang downward from the support hoop inside the cover.

Hence, the frame supports both the cover and the support hoop with its plurality of garments depending therefrom. The rod stock of which the frame is formed should be selected which is sufficiently sturdy to support the weight of the cover and the garments thereon without deforming. Since all the requisite structural support is provided by the frame, with the cover and support strap hanging from the frame, it is not necessary in this design for the cover to provide any structural support. Hence, it is not necessary in this design to provide a heavy cover or reinforce the cover. That is, since in this design the cover and hanger-receiving hoop or strap are supported on the frame, the cover may be made as lightweight as desirable without affecting the structural integrity of the garment carrier. This is in contrast with related designs of the prior art in which reinforcement of the cover portion of the garment carrier has a direct relation to the structural integrity of the garment carrier as a whole, and therefore does not allow for use of a lightweight cover material without reinforcing, which adds significant production costs.

Additionally, the upper, arcuate hook-like portion of the frame, by which the garment carrier is hand gripped during transport, is formed so as to allow for comfortable gripping and carrying of the garment carrier. The uppermost section of the hook-like frame portion is downwardly concave and has a span greater than the width of an adult human hand. Hence, the free end of the hook-like frame portion extends beyond the side of the hand when the hook-like portion is gripped manually. This eliminates the uncomfortableness associated with the leading end of the hook-like portion digging into the hand during transport. To further prevent digging of the leading end of the hook-like portion into the hand, the leading end of the hook-like portion does not extend substantially downward, as do conventional garment carrier hooks, but rather extends more closely to horizontal.

BRIEF DESCRIPTION OF THE DRAWINGS

In the drawings, wherein like elements are referenced alike:

FIG. 4 is a cross-sectional view of the support strap taken along line 4—4 of FIG. 3;

FIG. 5 is a perspective view of the garment carrier of FIG. 1, shown unfolded with garments supported therein;

FIG. 6 is a fragmented, side elevational view of the garment carrier of FIG. 1, shown in its unfolded configuration; and FIG. 7 is a side elevational view of the garment carrier of FIG. 1, shown in its folded configuration.

DETAILED DESCRIPTION OF THE PREFERRED EMBODIMENT

Figure 1:
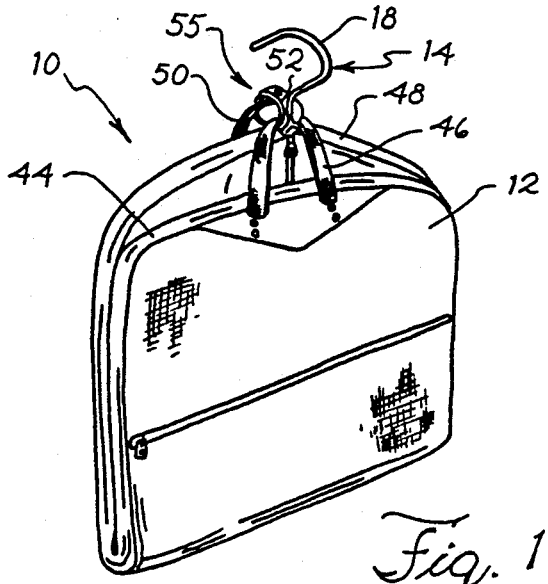
FIG. 1 is a perspective view of the front of a garment carrier embodying various features of the present invention, shown in its folded configuration.

A garment carrier embodying various features of the present invention is illustrated in FIGS. 1–7 and referred to generally by reference numeral 10. With initial reference to FIG. 3, the garment carrier 10 is comprised of a cover 12, frame 14 and a support strap or loop 16, all of which are easily assembled and easily manually separable from one another.

Figure 3:
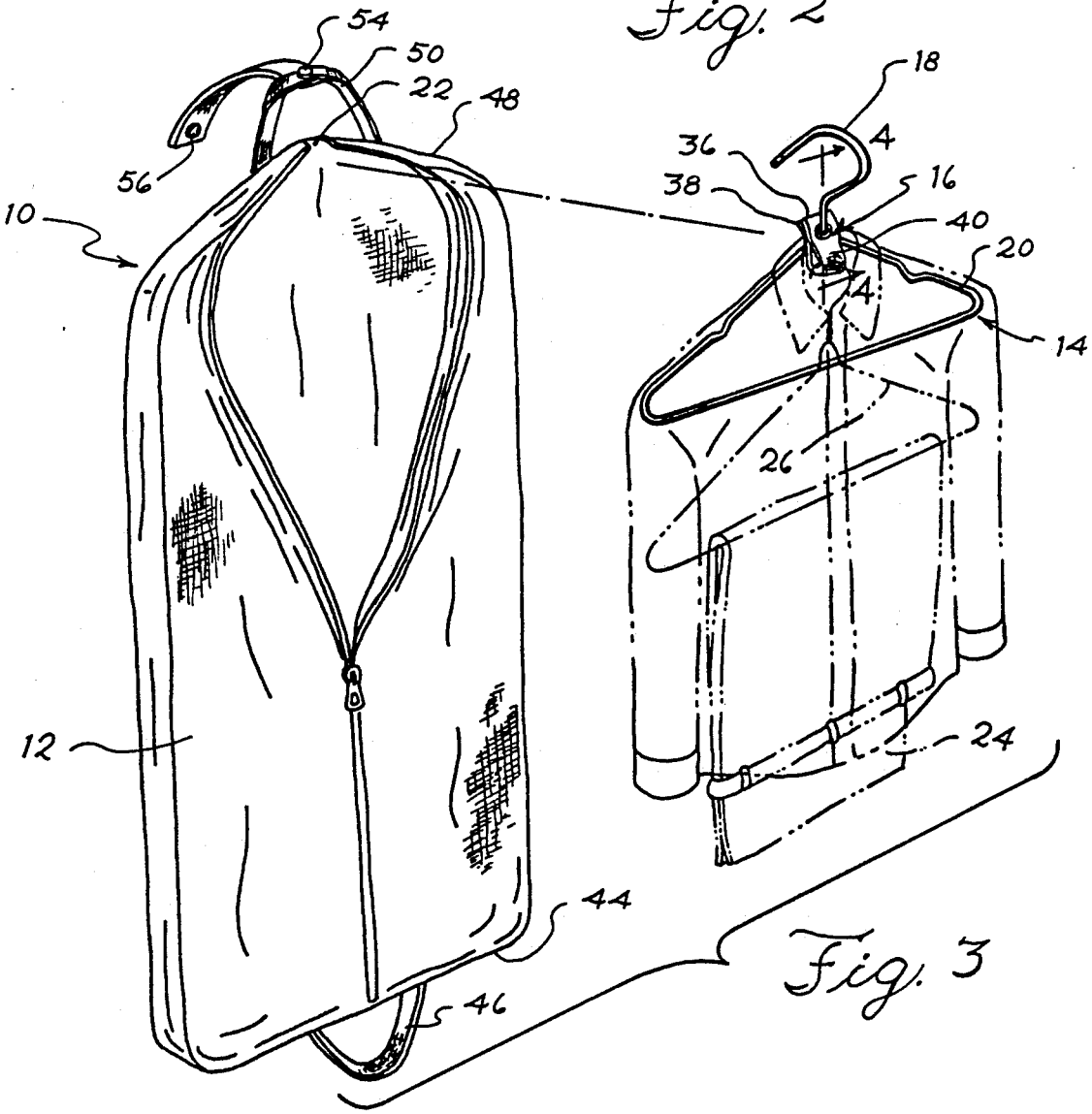
FIG. 3 is an enlarged perspective view of the garment carrier of FIG. 1, shown unfolded with the cover opened and separated from the remainder of the carrier.

The frame 14 is formed of bar stock which is bent into the hanger-like configuration shown in FIG. 3, with an upper hook-like hand gripping portion 18, and a lower triangular-shaped garment engaging portion 20. The frame 14 is manually insertable into the interior of the cover 12 as illustrated in FIG. 5, and easily removable from the interior of the cover 12 as indicated in FIG. 3. When the frame 14 is placed within the cover 12, the lower, triangular-shaped garment engaging portion of the frame 14 resides within the cover 12 and supports the cover, with the hook-like hand gripping portion 18 extending outside of the cover 12 through cover opening 22 to provide a gripping site.

While this arrangement is suitable for transporting one or two garments by placing the garments onto the frame 14 and then inserting the frame 14 into the cover 12, it is desired to further provide the garment carrier with the capacity to transport a plurality of garments supported on their respective hangers. With reference to FIG. 3, in order to accommodate the additional garments 24 on their respective hangers 26, the support strap 16 is employed.

The support strap 16 has a lower aperture 28 and an upper aperture 30. The hook portions 32 of each of the plurality of hangers 26 on which respective garments are supported are received within the lower aperture 28, with the support strap 16 then placed onto the frame 14 by receipt of the upper hook-like portion of the frame 14 through the upper aperture 30 of the support strap 16. The support strap 16 then resides at the junction between the upper hook-like portion 18 of the frame 14 and the lower triangular portion of the frame 14, as seen in FIGS. 3 and 5. A plurality of clothes hangers 26 are shown supported by the support strap 16 in FIG. 3, whereas only one clothes hanger 26 is shown in FIG. 3, but it is readily appreciated that any number of hangers may be accommodated within the lower aperture 28 of the support strap 16.

The support strap 16 is preferably formed of leather, due to its strength and longevity. In the illustrated embodiment of the invention, a strip of leather or other suitable material is folded in half onto itself, with the opposite free ends 36 and 38 of the strip joined together. The loop 40 at the folded continuous end of the strip defines the lower aperture 28 suitable for receiving the hooks 32 of a plurality of garment supporting hangers therein, as illustrated in FIGS. 3, 4 and 5.

As best illustrated in FIG. 4, the free ends of the strip are joined together by a rivet 42 having an upper surface 44 and a lower surface 46 which press together on opposite sides of the strip in proximity with the free ends 36 and 38 of the strip. The rivet 42 has an aperture 30 therein which serves as the upper aperture 30 of the support strap 16 and which receives the upper hook-like portion of the frame 14 therein.

Hence, the support strap 16 is mounted to the frame 14 by sliding the support strap 16 onto the upper hook-like portion 18 of the frame 14, by passing the hook-like portion of the frame 14 through the upper aperture 30 of the support strap 16. The support strap 16 is slid over the hook-like portion 18 of the frame 14 until it abuts the lower triangular-shaped portion 20 of the frame 14. The strap 16 resides thereat, supported by the frame 14. Hangers 26, supporting respective garments 24, are supported by the hoop 40 of the support strap 16 by receipt of the hooks 32 of each of the hangers 26 within lower aperture 28 of the support strap 16. Thus, the frame 14 now supports the support strap 16 with a plurality of hangers 26 with respective garments depending from the support strap 16. The lower, triangular-shaped portion 20 of the frame 14 may also support one or more garments directly thereupon as illustrated in FIGS. 3 and 5.

The frame 14, support strap 16 and garments 24 on respective hangers 26 are then placed within the cover 12, whereupon the lower end of the support strap 16 resides within the cover 12, with the hangers 26 and their respective garments depending downwardly from the support strap 16 also residing within the cover 12, as seen in FIG. 5.

The cover 12 is supported by the frame 14, and rests on the lower triangular portion 26 of the frame, depending downward therefrom. The cover has an opening 22 at its upper end, and preferably includes a zipper or other suitable closure on the front side 34 of the cover 12 which extends the length of the cover. The zipper is unzipped to allow insertion of the frame and support strap, with garments depending therefrom, into the interior of the cover. Thereafter, the zipper is zipped closed to contain the garments therein and shield the garments from external elements.

In order to minimize discomfort during transport of the garment carrier, the upper, arcuate hook-like portion 18 of the frame 14 is downwardly concave with a span greater than the width of a human hand. The free end of the hook-like portion 18 of the frame 14 does not extend substantially downwardly as do conventional hanger hooks, but rather extends substantially horizontally such that a line tangential to the free end preferably extends between 5° and 60° from horizontal. The large span of the hook-like portion 18 allows for manual gripping of the hook-like portion 18 of the frame 14 without the free end thereof contacting the hand so as to eliminate the discomfort associated therewith. The substantially horizontal free end further reduces the chances of the free end digging into the hand gripping the hook-like portion 18 of the garment carrier 10 during transport. However, the downward concavity is sufficient to allow hanging of the garment carrier 10 from a convention clothes rod. Finally, the free end of the hook-like portion 18 may be provided with a rubber tip or the like to further minimize chances of discomfort during transport of the garment carrier 10.

Figure 2:
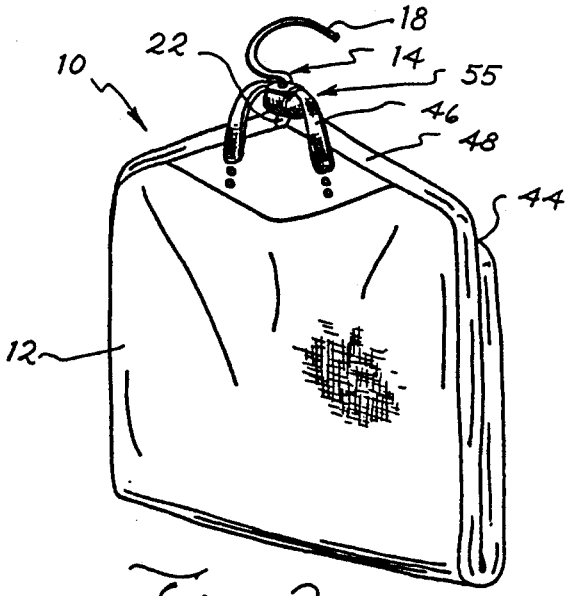
FIG. 2 is a perspective view of the rear of the folded garment carrier of FIG. 1.

Conveniently, the garment carrier 10 may be folded in half to minimize storage space by bringing the lower end 44 of the cover 12 upward to the upper end 48 of the cover. The lower end 44 of the cover 12 has a strap 46 which is passed over the hook-like portion 18 of the frame 14, as illustrated in FIGS. 1, 2 and 7, to retain the cover 12 and the garments therein in the folded position.

To prevent the strap 46 from inadvertently moving back over the hook-like portion 18 of the frame 14, and the carrier 10 thus becoming inadvertently unfolded, first and second restraining straps 50 and 52 are provided at the upper end 48 of the cover 14. First restraining strap 50 is mounted to the cover 14 near its upper end 48 and includes the male component 54 of a snap 55. Second restraining strap 52 is affixed to the first restraining strap 50, approximately midway thereacross, and includes a female component 56 of the snap 55 near its free end. After the strap 46 is placed over the hook-like portion 18 of the frame 14, the second restraining strap 52 is passed through the strap 46 and the female component 56 of the snap 55 engaged with the male component 54 of the snap 55 to restrain the strap 46 and prevent the garment carrier 10 from becoming inadvertently unfolded, as best illustrated in FIG. 7. The garment carrier 10 may be transported or hung from the hook-like portion 18 of the frame 14, with the cover 12 and garments 24 either folded as in FIGS. 1, 2 and 7 or unfolded as in FIG. 5.

While the invention has been described with reference to a preferred embodiment, it will be understood to those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A garment carrier for supporting a plurality of garments mounted on respective hangers having hooks, for transportation of the garments, the garment carrier comprising:

a cover for at least substantially covering said plurality of garments having an opening in its upper end;

a frame having a lower cover supporting portion disposed within said cover for engagingly supporting the cover thereon, and an upper hand gripping portion integral with the lower cover supporting portion and extending outward of the opening in the upper end of the cover; and a support strap having frame engaging means for removably mounting directly onto and off of said upper hand gripping portion of said frame, said support strap having hanger engaging means disposed within said cover said hanger engaging means being adapted to engagingly receive each of the hooks of the plurality of hangers having garments thereon, to support each of the plurality of garments at approximately the same height within said cover;

said frame engaging means comprising a first aperture which extends completely through said strap by which the strap is slidable onto and off of said hand gripping portion of said frame, and said hanger engaging means comprising a second aperture defined by the loop formed by said strap looping back over itself in which the hooks of the plurality of hangers of the respective garments are slidably received.

2. A garment carrier in accordance with claim 1 wherein said first and second apertures define respective first and second passageways which extend generally perpendicular with respect to one another.

* * * * *